United States Patent [19]

Greene

[11] 4,137,576

[45] Feb. 6, 1979

[54] SWIMMING POOL

[76] Inventor: Samuel Greene, 18 Underwood Dr., West Orange, N.J. 07052

[21] Appl. No.: 764,192

[22] Filed: Jan. 31, 1977

[51] Int. Cl.[2] ..... E04H 3/18

[52] U.S. Cl. ..... 4/172.19; 52/655

[58] Field of Search ..... 4/172.19, 172.21, 172; 52/668, 655, 169.7, 169.8, 295, 293

[56] References Cited

U.S. PATENT DOCUMENTS

| | | | |
|---|---|---|---|
| 2,129,466 | 9/1938 | Ferguson | 52/655 |
| 2,365,175 | 12/1944 | Crawford | 52/655 |
| 3,785,108 | 1/1974 | Satchell | 52/655 |
| 3,991,530 | 11/1976 | Scourtes | 4/172.19 |

*Primary Examiner*—Richard E. Aegerter
*Assistant Examiner*—L. Footland
*Attorney, Agent, or Firm*—Edward R. Weingram

[57] ABSTRACT

An above ground swimming pool having a rigid retaining wall using interconnecting components which are mainly slotted and notched to form the primary connection and minimally bolted to form the secondary connection.

The retaining wall is supported by an improved "A" frame made up of three interfitted members held in assembled position by a tie bolt.

The retaining wall has wall sections or sheets slid into opposite facing grooves of two "Z" bars mounted on the wall posts of the retaining wall.

A sectional walk deck is snap-fitted to the retaining wall. A picket fence surrounds the walk deck and is connected to a flat plate passing through a slot in the rail post to sandwich the post between adjacent fence sections.

20 Claims, 14 Drawing Figures

60
66
64
62
58
68
70
70
194
218
192
220
40
76
70
72
80
24
126
114
78
28
28
74
26

76
84
84
A'
A
B'
82
104
100
94
102
B
106
166
168
66
64
62
94
92
166
168

218
222
220
210
222
228
232
182
234
230
180
40
198
196
192
216
222
220
232
234
54
218
224
228
210
182
204
40
230
180
192
196
198
200
228
194
194
222
232
234
202
214
212
228
208
206
224
220
210
226

SWIMMING POOL

BACKGROUND OF THE INVENTION

Swimming pools of the prior art required a maximum number of screw fasteners. Only limited use was made of nonfastener interconnecting components. The rigid wall type of pools was complex and difficult to align and assemble. Excessive cost and questionable safety also presented unsolved problems for both the manufacturer and the purchaser.

SUMMARY OF THE INVENTION

It is an object of the present invention to provide an improved above-ground swimming pool and retaining wall for the same which avoids the prior art disadvantages; which is simple, economical, and reliable; which uses a maximum number of nonfastener interconnections and a minimum number of screw fastener connections; which uses an "A" frame to form a triangular support for the retaining wall; which uses notched horizontal braces between adjacent wall posts; which uses reversible "Z" bars, wall post connected, to carry the wall sheets or sections; which has a sectional walk deck, snap-fitted to mount on short horizontal braces affixed to the wall posts and which includes a sectional picket fence having sections joined to each other through the rail posts via connected plates inserted within the hollow of the top rail member.

Other objects and advantages will be apparent from the following description of the illustrated embodiment of the invention and the novel features will be particularly pointed out hereinafter in the claims.

A BRIEF DESCRIPTION OF THE DRAWINGS

The present invention is illustrated in the accompanying drawings in which.

DESCRIPTION OF THE INVENTION

Figure 1:
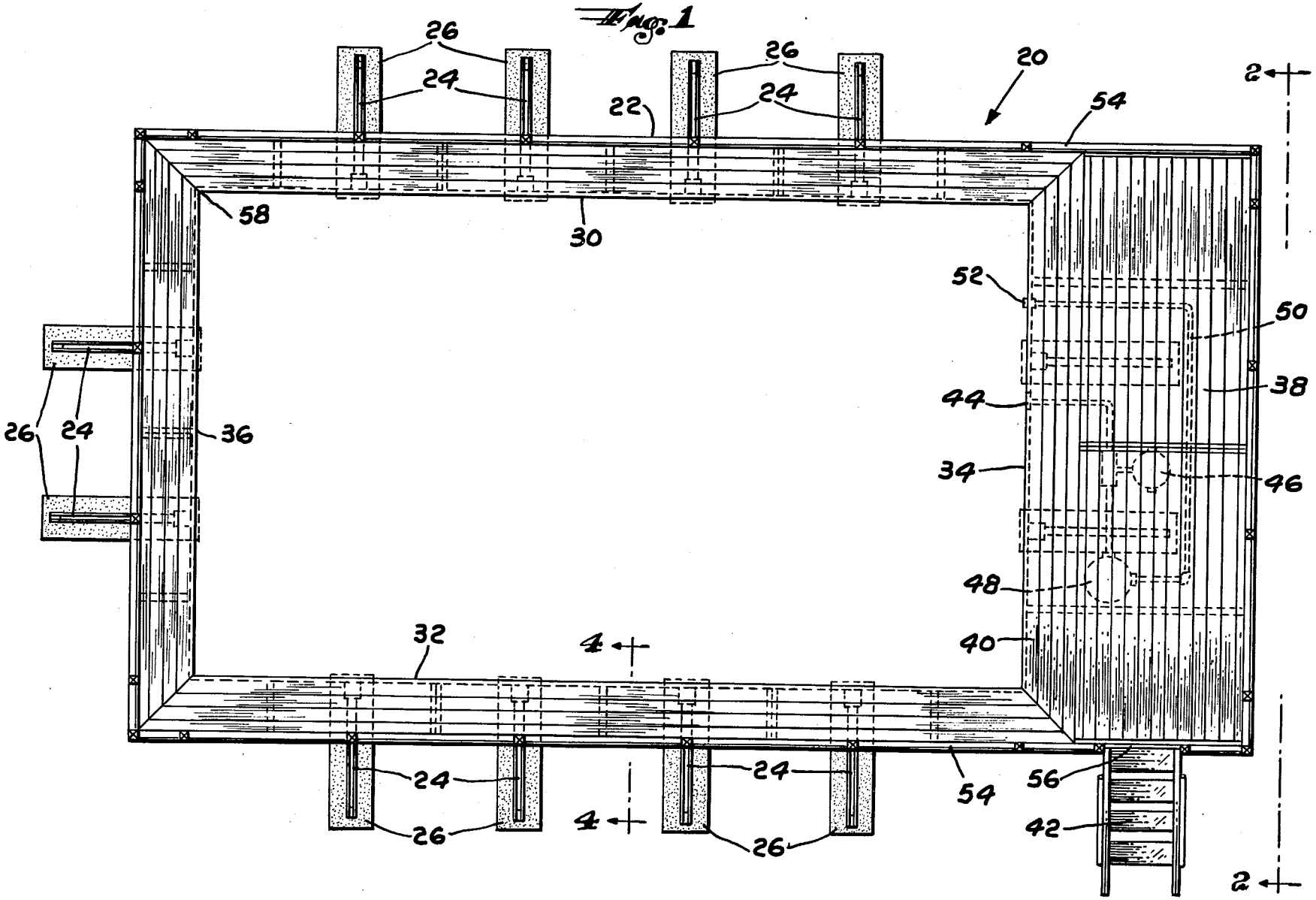
FIG. 1 is a top plan view of a swimming pool embodying the present invention.
Figure 2:
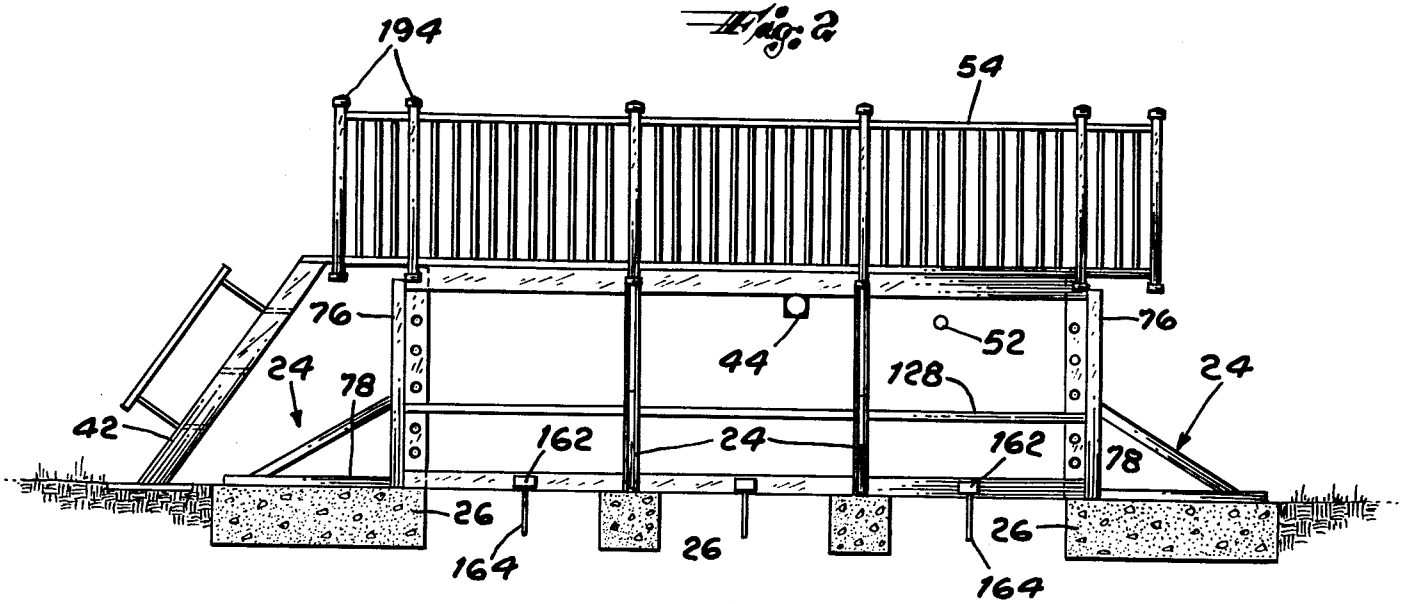
FIG. 2 is a side elevational view taken from the right end of FIG. 1, looking in the direction of the swimming pool.
Figure 3:
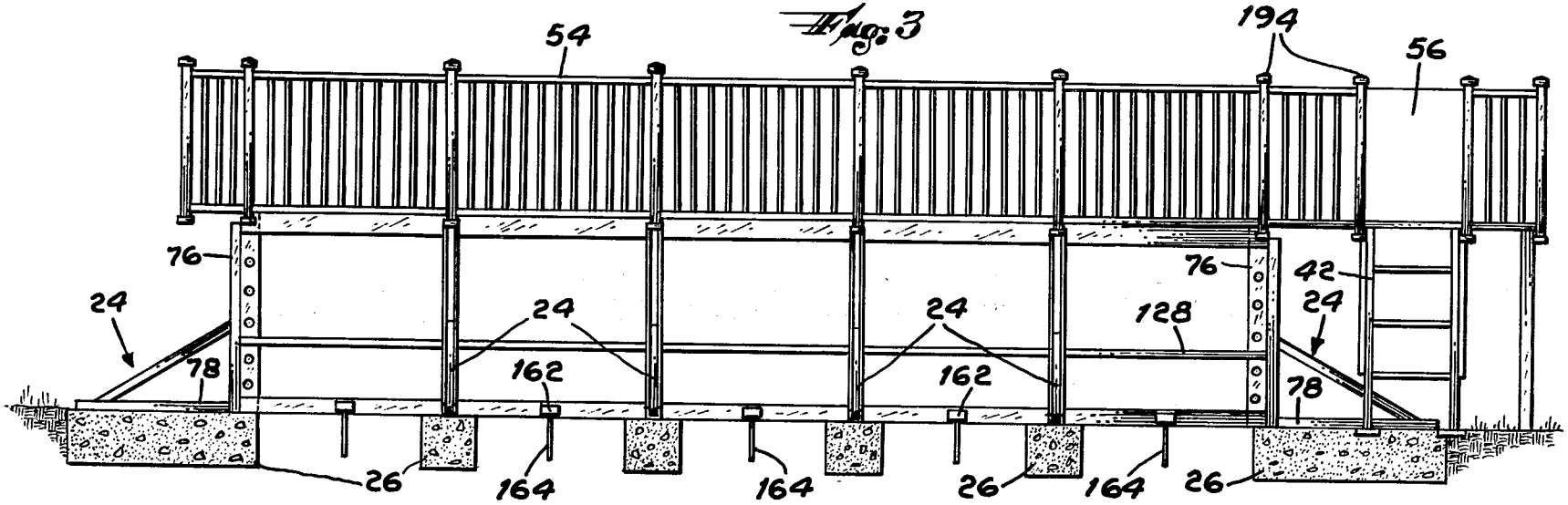
FIG. 3 is a front elevational view of the swimming pool.

In the illustrated embodiment of the invention, FIG. 1 depicts a swimming pool, designated generally 20, having a pool or retaining wall 22 which is supported by a plurality of interconnected "A" frames 24 which are secured to concrete footings 26 by anchor bolts 28. The pool 20 is preferably rectangularly shaped but can conveniently be made to be any other shape desired. The pool 20 as shown in FIG. 1 has a top side 30, bottom side 32, right side 34, and left side 36. The right side 34 has a sundeck 38 which is integrally formed with and connected into a perimeter walk deck 40. A ladder 42 illustrated in FIGS. 1, 2 and 3, provides entrance and egress to the sun deck 38 and pool 20 which is built above ground. The conventional water circulation and purifying components shown in FIG. 1 may be conveniently mounted under the sun deck 38 and include an automatic skimmer 44, a pump and motor 46, a filter 48, and piping 50, which delivers the purified processed pool water back to a return inlet 52.

A picket fence 54 shown in FIGS. 1, 2 and 3, surrounds the perimeter of the walk deck 40 and the sun deck 38, with an opening 56 formed at the top of the ladder 42.

Figures 4, 5:
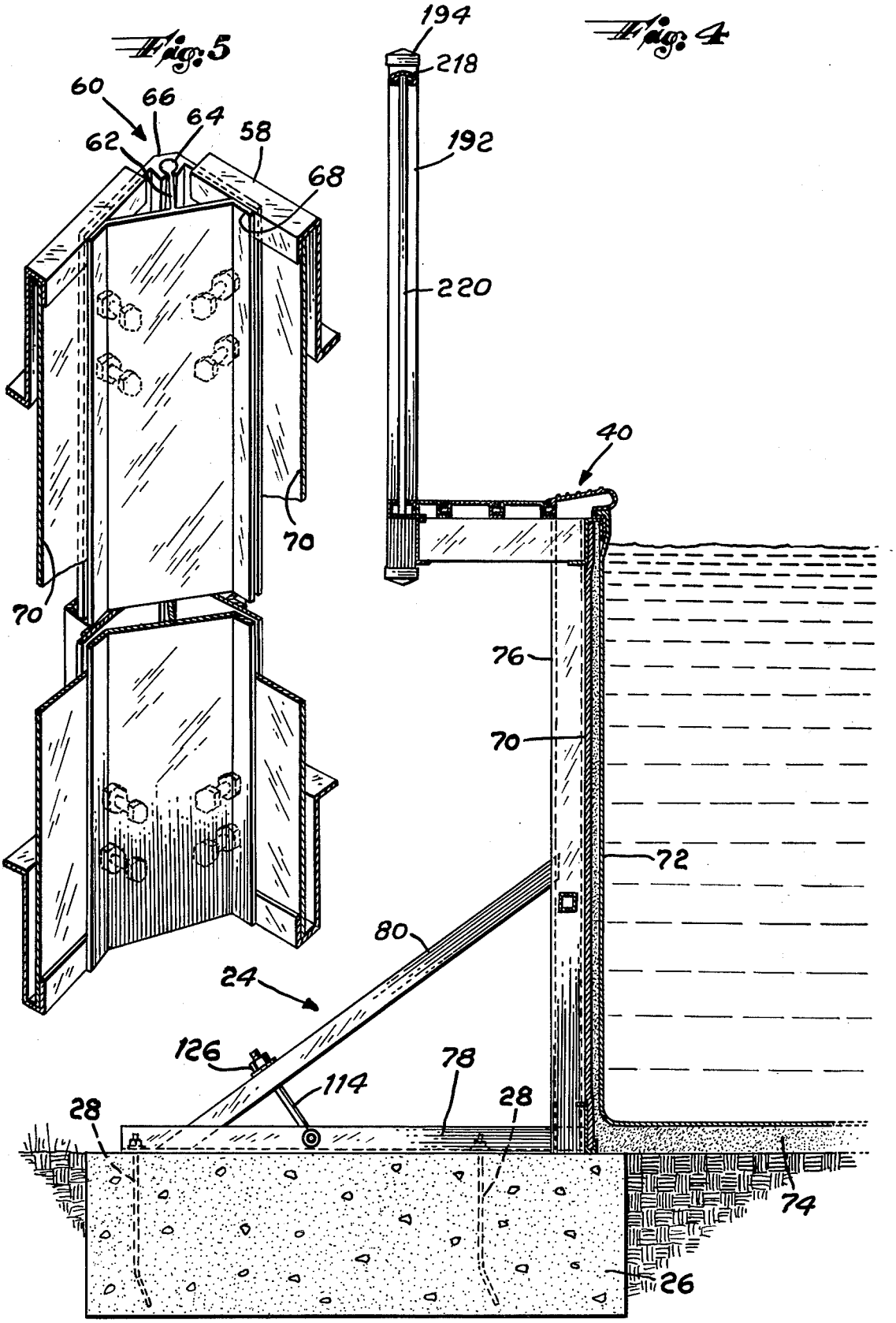
FIG. 4 is an enlarged elevational view, partly in section, taken along line 4—4 of FIG. 1.
FIG. 5 is a top plan view of one corner of the pool.

The pool has the "A" frames 24 spaced about each of the sides 30, 32, 34 and 36 at a predetermined distance from each other so as not to require separate support at the corners 58. To prevent the pool corners 58 from being sharp 90 degree angles, a "T" shaped corner insert 60 shown in FIG. 5 is used to cut the angle to an acceptable 45 degrees. The insert 60 has a stem 62 which is slid into a vertical arcuate slot 64 formed in a corner post or member 66 bolted to the retaining wall 22. The bottom of the stem 62 is bulbous to nonremovably fit within the slot 64. The tips 68 of the top of the insert 60 are bent to lie flat against the wall sections or sheets 70. The wall sections 70 are illustrated in FIG. 4 as backing a plastic vinyl liner vertically, while the bottom of the liner 72 rests upon a sand base 74. When filled with water, the liner 72 will rest upon and be supported by the wall sections 70 and the base 74.

Figures 7, 9:
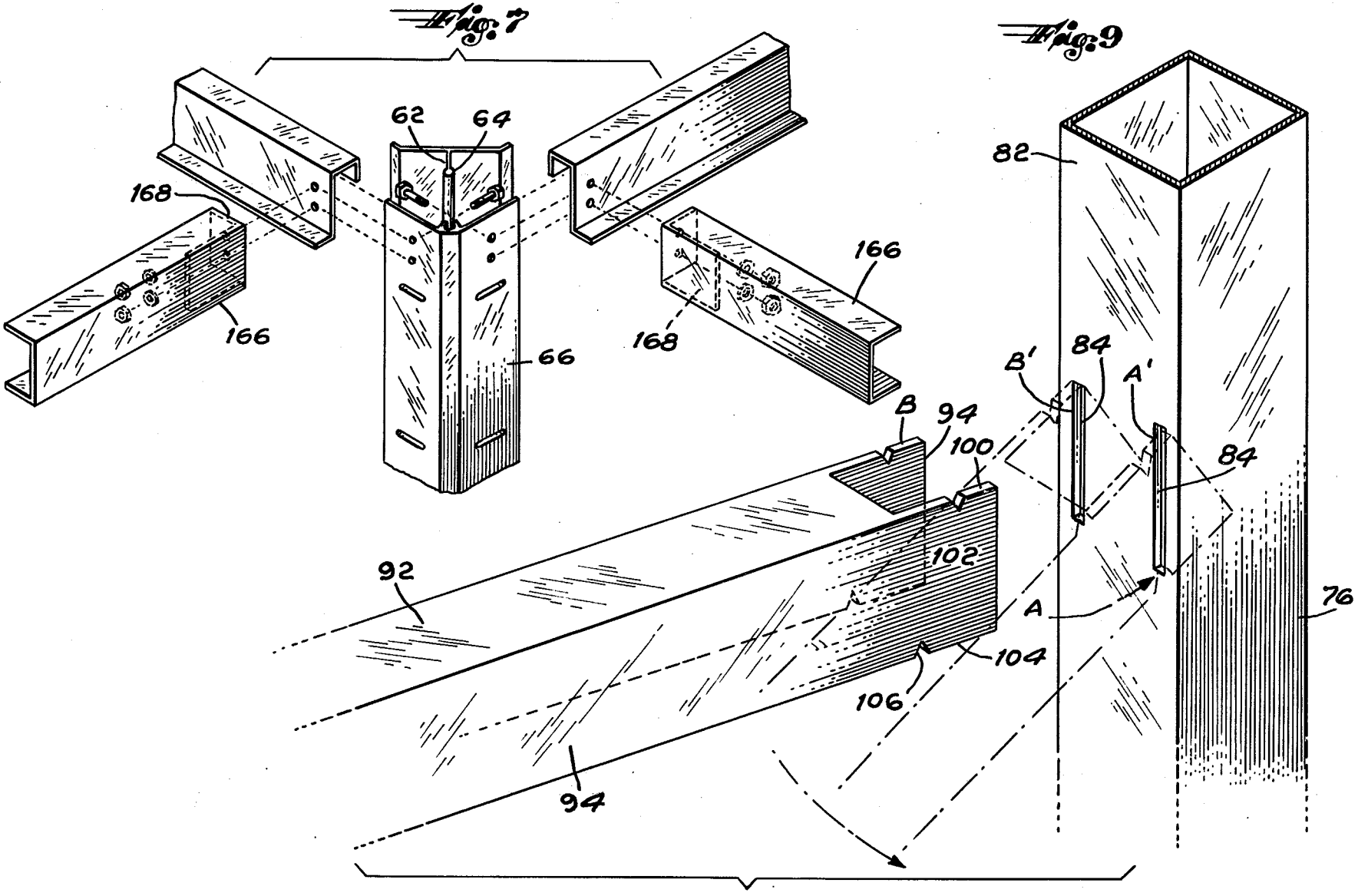
FIG. 7 is an exploded perspective of the upper portion of a wall corner post.
FIG. 9 is a diagrammatic perspective view of the top portion of the "A" frame including the vertical member wall post and the inclined member.
Figures 10, 11:
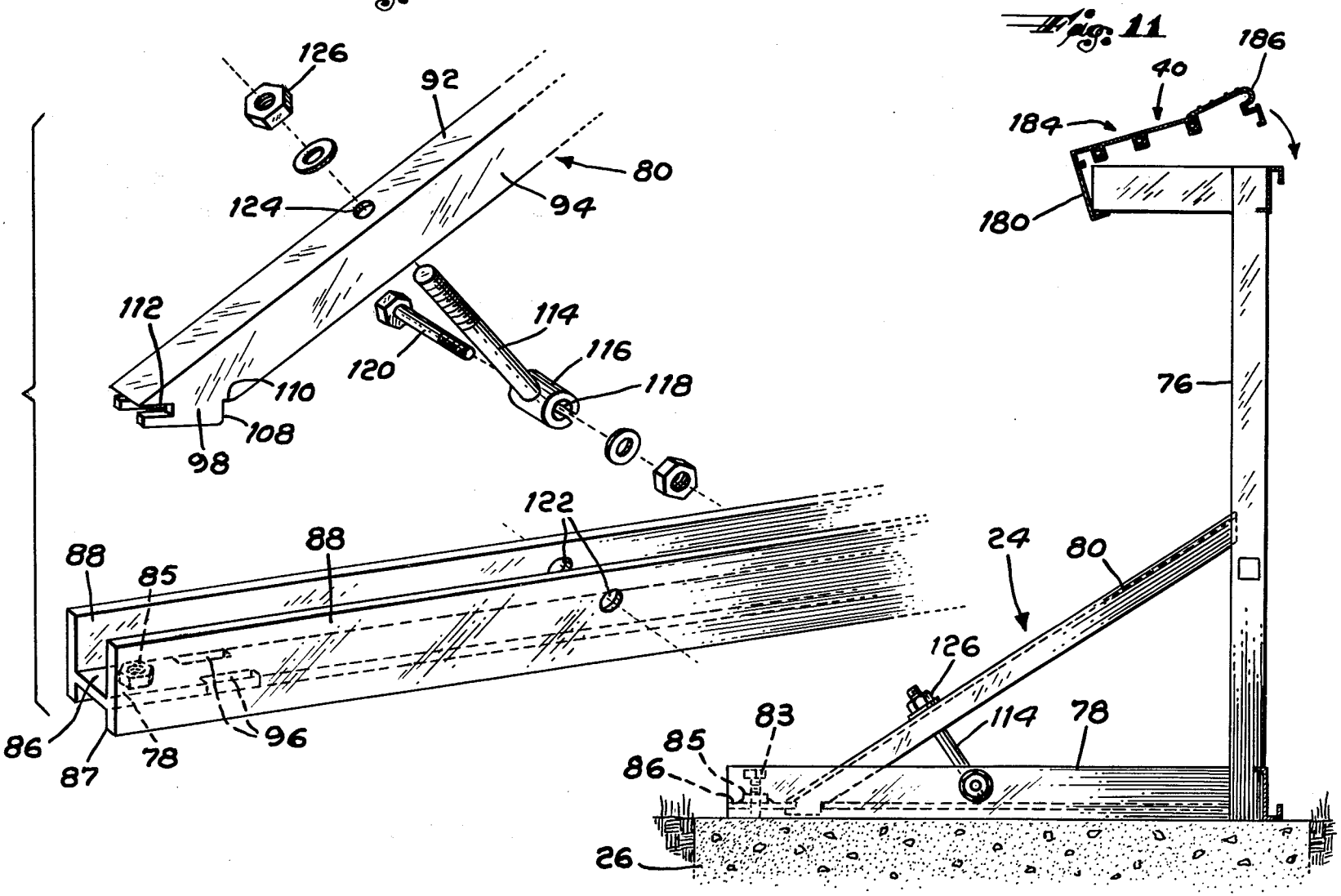
FIG. 10 is a perspective view of the lower outer end of the "A" frame including the horizontal member, the inclined member and the tie bolt.
FIG. 11 is a side elevational view of the "A" frame, including a diagrammatic side elevational view of the retaining wall including the walk deck being snap fitted.

The "A" frames 24 are illustrated in FIGS. 4, 9, 10 and 11 and include the nonfastened interconnected vertical member or wall post 76, horizontal member 78 and inclined member 80. The post 76 is a tubular square with the external face 82 having parallel vertical slots 84. The horizontal member 78 is suitably connected to the bottom of the post 76 as by welding, bolts, bent tab in slot or the like, so as to extend outwardly from the face 82. The horizontal member 78 is channel-shaped with the open side facing upwardly. A middle plate 86 is formed up from the bottom so as to leave a space 87, in which the side paltes 88, 88 confine the space and define short legs which will rest on the footings 26. Parallel slots 90, 90 are formed in the middle plate 86 adjacent its end. The inclined member 80 is channel-shaped with the bottom open, a top plate 92 and two facing sides 94, 94. The top plate 92 is cut back adjacent the top end 96 and the bottom end 98. Each of the sides 94 is substantially "V" notched on top edge 100 at 102 and on the bottom edge 104 at 106. Notch 102 is nearer the top end 96 than is notch 105. The width of the sides 94, 94 is slightly less than the length of the slots 84, 84 so that when the inclined member 80 is presented to the post 76 in a horizontal plane the sides 94, 94 will easily pass into the post slots 84, 84. Upon swinging the inclined member downwardly the "V" notches 102 and 106 will abut the slots 84, 84 at the top inner wall and the bottom outer wall to hold the inclined member 80 at desired angle as depicted in FIGS. 9 and 11 which in the preferred embodiment is 45 degrees.

Also, the depth of the notched 102 and 106 is set to permit the desired angle to be obtained. Each side 94 at the bottom end 98, as is shown in FIG. 10, which intersects the bottom edge 104, has a stepped notch 108 which terminates in a shoulder 110. An angular straight slot 112 is set at a complimentary angle of 45 degrees extends inwardly from the top edge 100 a short distance from the outer end in alignment with the shoulder 110. The inclined member 80 is sized to fit within the sides 88, 88 of the horizontal member 78. The bottom end 98 will be angled to permit the sides 94, 94 to be inserted into the slots 90, 90. The upper slot 84, notches 102 and and 106 will act as a "pivot" to allow the bottom end 98 to be moved within the slots 90, 90 back and forth to seat the shoulders 110 upon the upper surface of the middle plate 86, and have the straight slot 112 sandwiching the middle plate 86 forwardly of the slots 90, 90. Thus the inclined member 80 is securely locked and interconnected with the wall post 76 and the horizontal member 78, all without the use of screw fasteners. However, to permit (1) greater manufacturing tolerances; (2) angular adjustment of the "A" frame 24; and (3) a predetermined tensioning of the inclined member 80, a tie bolt 114 is used to secure the inclined member 80 to the horizontal member 78, as illustrated in FIG. 10.

Figure 8:
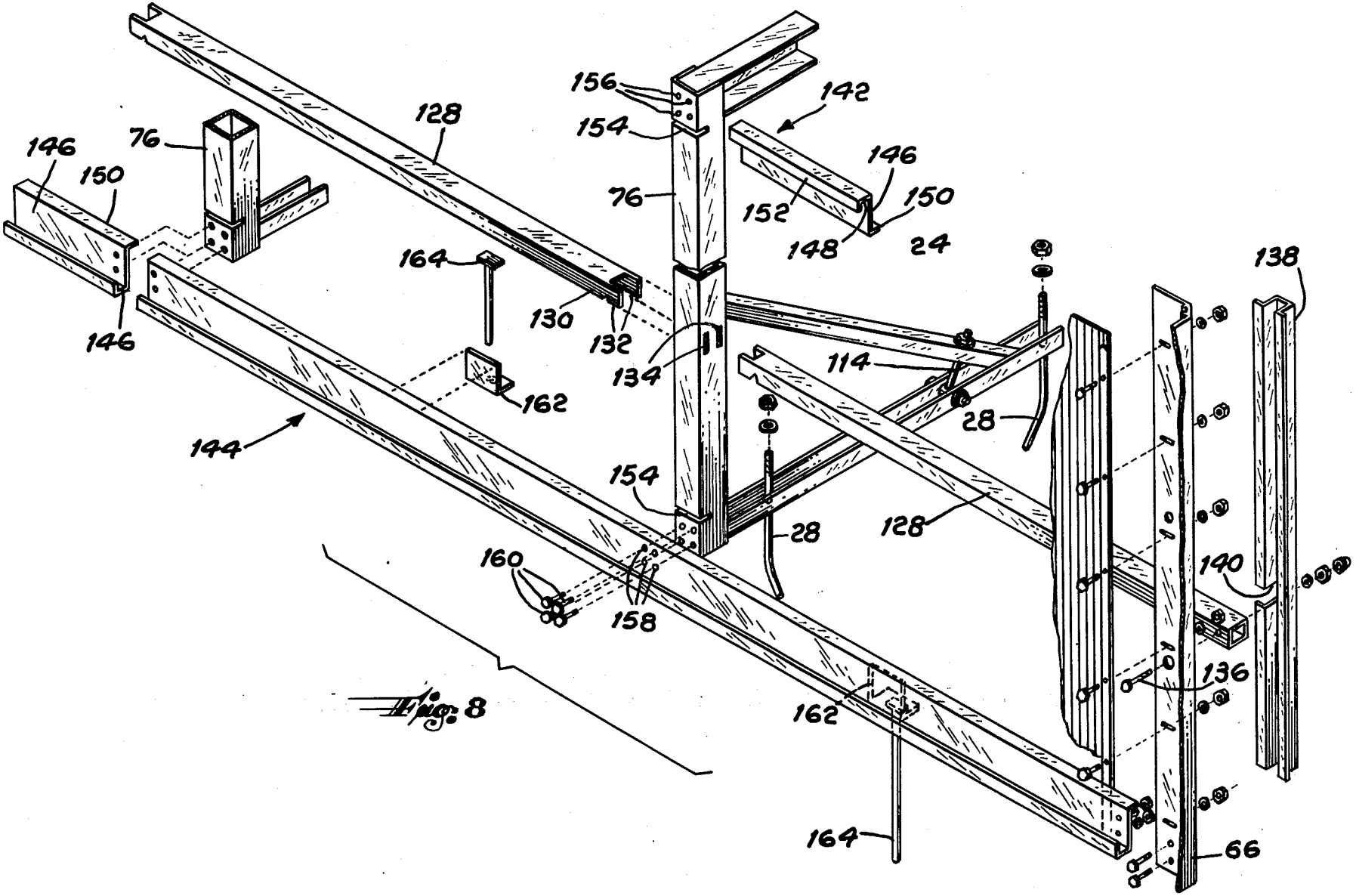
FIG. 8 is an exploded perspective of the retaining wall including the top and bottom "Z" bars and the horizontal braces for the wall posts.

The tie bolt has an enlarged head 116 with a central opening 118 through which a connecting pin 120 snugly fits, with the pin 120 secured into aligned apertures 122, 122 formed in the side 88, 88 a pre-set distance inwardly of the end of the horizontal member 78. The stem end of the tie bolt 114 is threaded and extends through an aperture 124 formed in the top plate 92 of the inclined member 80 to receive a nut and washer 126 which is tightened to complete the assembly. The retaining wall shown in FIGS. 3, 6 and 8 has the wall posts 76 spaced from each other by horizontal braces 128 formed of tubular squares. The top and bottom of the ends of the braces are cut away, while the sides 130 remain and are otched on the bottom edge at 132. The wall post 76 has parallel vertical slots 134 formed on the opposite sides thereof. The brace sides 130, 130 are inserted into the slots 134, 134 wherein the notches 132, 132 will engage the wall of the posts 76 adjacent the bottom of the slots 134 to hold and stiffen the wall posts 76 without the need of screw fasteners. At the corner posts 66 the ends of the horizontal brace 128 are bolted to the post 66 as by screw connectors 136 as is illustrated in FIG. 8. A cover 138 having a cut out 140 which fits over the end of the brace 128 is connected to the corner post 66 to present a smooth external surface.

The "A" frame 24 makes use of the external or front face 82 of the wall posts 76, the horizontal braces 128 are latched via notches 132 to the oppositely facing sides of the wall posts 76, the internal or rear face best seen in FIG. 8 is used to carry the top and bottom "Z" bars or wall retainers 142 and 144 respectively. "Z" bars 142 and 144 are identically formed but are mounted to have the external grooves 146, 146 face each other. The "Z" bars 142, 144 each have a body portion 148 which has a 90 degree flange 150 turned in one direction at one edge and the groove 146 turned in the other direction at the other edge. The groove 146 is a 90 degree flange to which a second 90 degree bend has been added to form a lip 152. A horizontal slot 145 is formed on the rear face of the wall post 76 adjacent both the top and bottom. Four apertures 156 are formed in a square pattern between the slot 154 and the top or bottom, respectively.

The flange 150 is slid into the slot 154 so the top bar 142 has its body portion 148 disposed above and the groove 146 facing downwardly. The "Z" bar 144 has its body portion 148 disposed below, so that the groove 146 faces upwardly. Each "Z" bar 142 and 144 has a square pattern of apertures 158 formed in alignment with the post apertures 146 to permit tapping screws 160 to connect the "Z" bars 142 and 144 to the posts 76 subsequent to the flanges 150 being disposed into the slots 154. The bottom "Z" bar 144 has affixed on the external or post side by welding or otherwise attaching to it a support angle 162 through the bottom leg of which is driven into the earth a drive rod 164 to further tie the retaining wall 22 to the surrounding ground.

The attitude of the entire A-frame assembly and, therefore, the precise angle of vertical wall post 76 can be adjusted by turning leveling bolt 83 within leveling hex nut 85 welded to middle plate 86 of the horizontal member.

The corner post 66 is an angle member resting on a patio block 165 (FIG. 6) which as shown in FIG. 7 will slip into the groove 140 of the "Z" bar 142 or 144 to be bolted against the inside surface of the body portion 146 instead of the outside surface as are the wall posts 76. This connection is repeated for the top and bottom "Z" bars 142 and 144.

Figure 6:
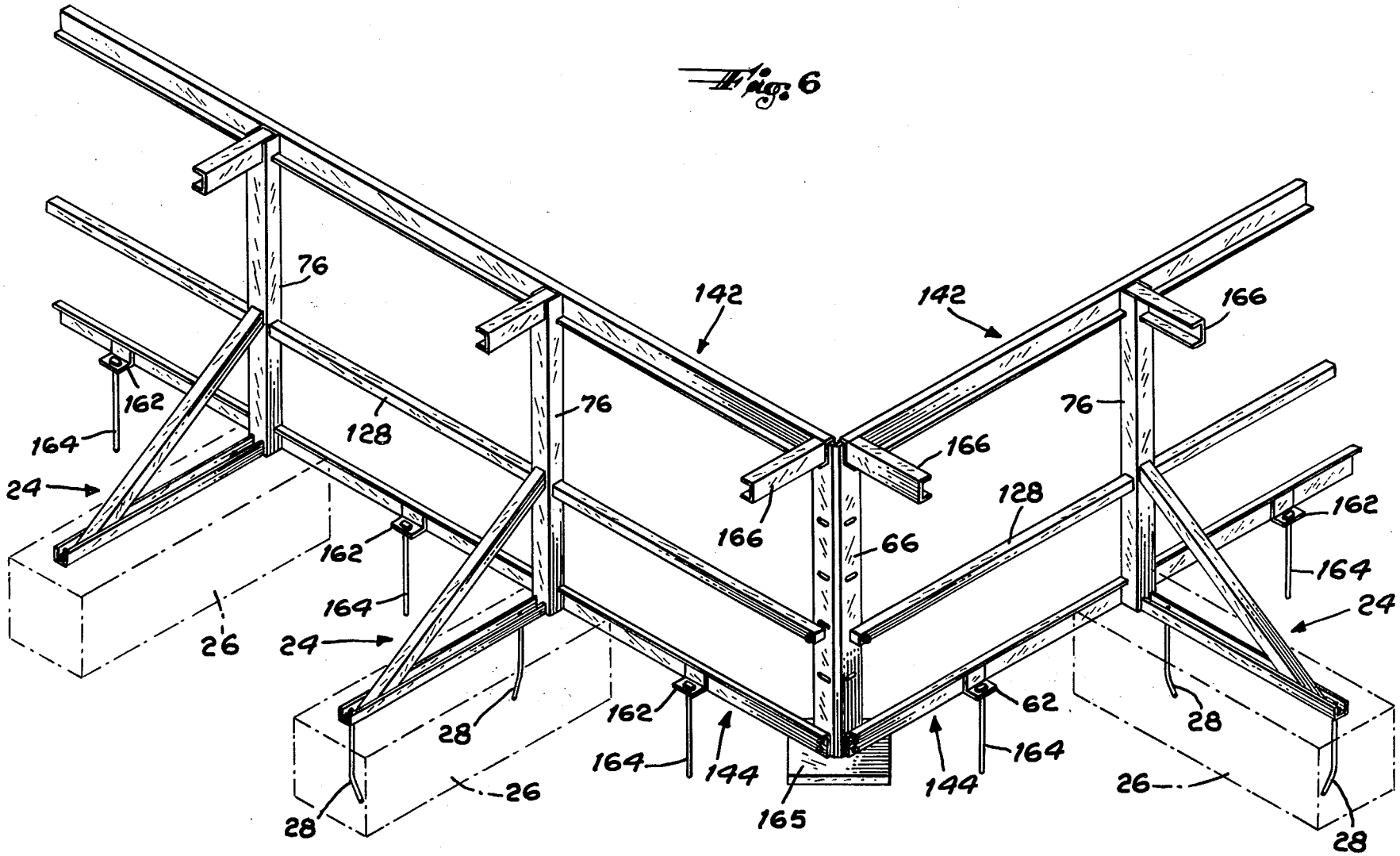
FIG. 6 is a fragmentary perspective view of one corner of the pool including the "A" frames.

The flange 150 of the "Z" bar 142 stands out from the corner post 66 and acts as a step upon which will rest the deck support or short horizontal brace 166 made from a "C" channel having affixed thereto a connecting angle 168 which will also be bolted in place along with the top "Z" bars 142. The deck supports 166 shown in FIGS. 6, 7 and 8 are connected to the top of each of the wall posts 76 on the external face 82 thereof. The wall posts 76 may be suitably slotted to permit the deck supports 166 to have their connecting angles positioned to threadedly receive the self tapping screws which assemble the same.

Once the "Z" bars 142 and 144 are assembled, the wall sections 70 illustrated in FIGS. 4 and 8 are slid in place with the top and bottom ends thereof held captive within the grooves 142 with the lip 152 preventing accidental displacement. At the corner posts 66 a vertical wall bar is bolted to the corner posts 66 to entrap the end of the wall section and hold it securely in assembled position. Also, since the corner post 66 defines an inside or closed angle the possibility of the wall section 70 becoming dislodged is nil.

Figure 12:
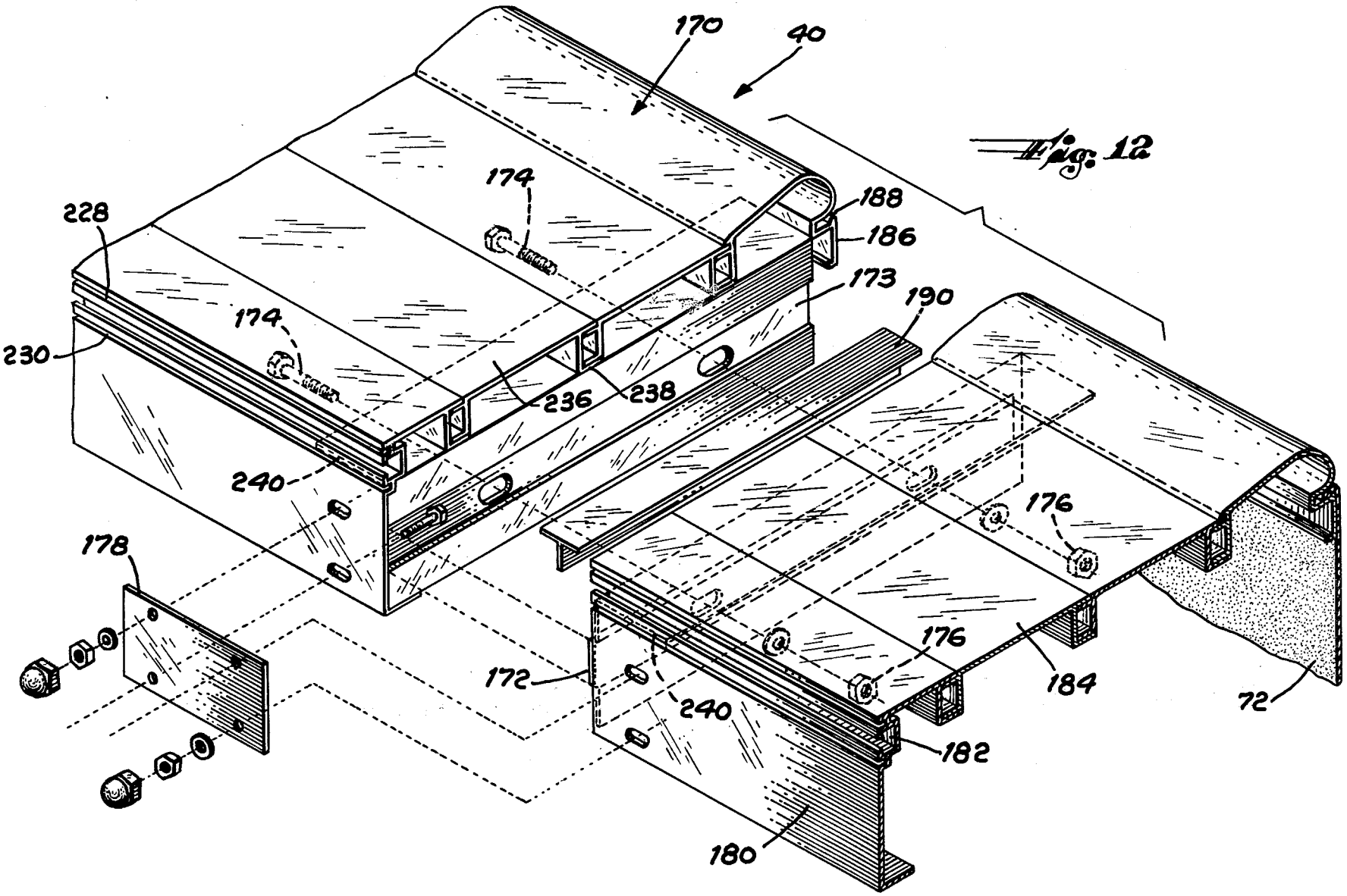
FIG. 12 is an exploded fragmentary perspective view of two connected walk deck sections.
Figures 13, 14:
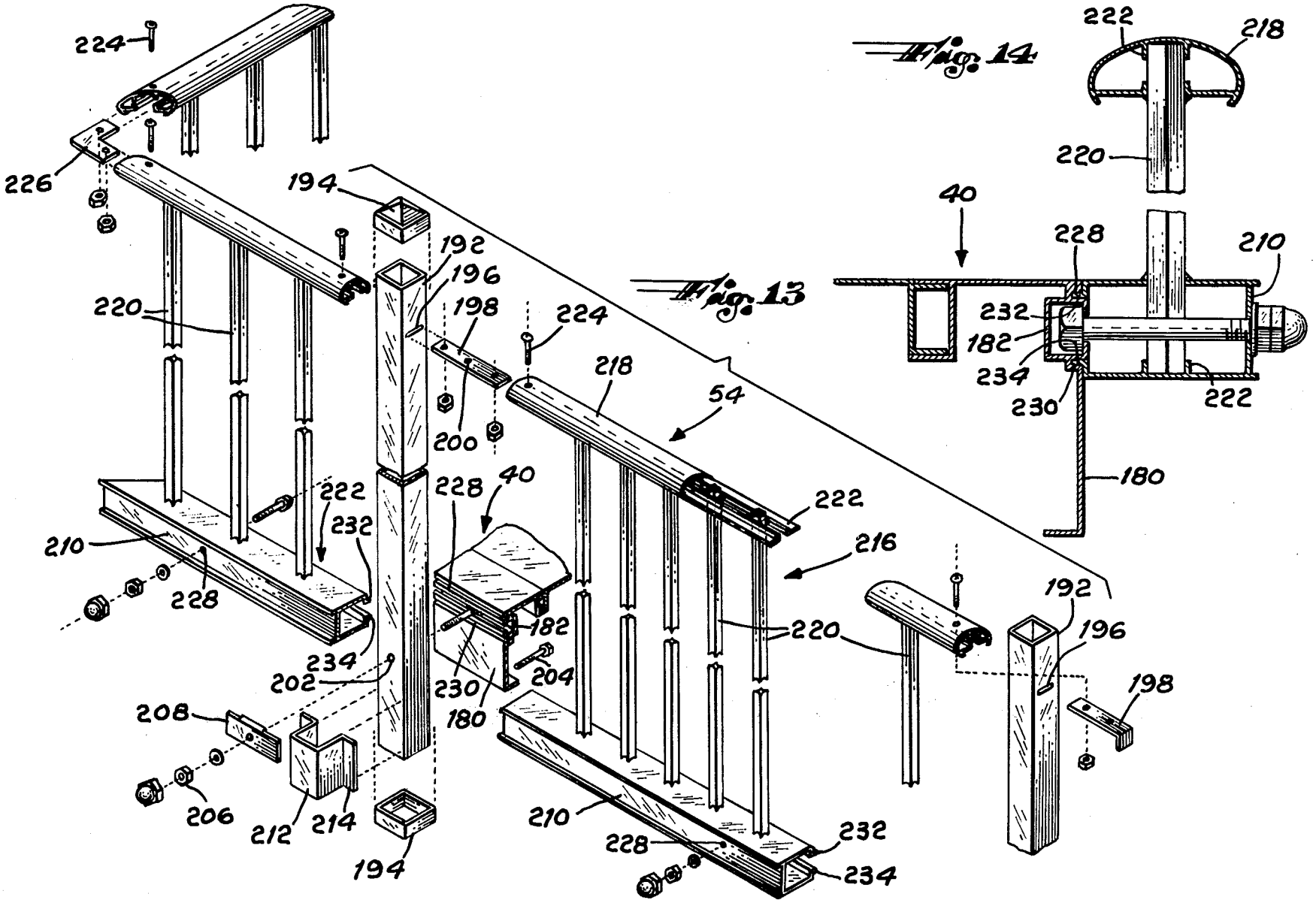
FIG. 13 is an exploded fragmentary perspective view of the picket fence and railing.
FIG. 14 is a side sectional elevation of the picket fence and railing.

The perimeter walk deck 40 is shown in FIGS. 1 and 4 and detailed in FIGS. 12 and 13, will have a high friction non-slip surface. The walk deck 40 is made up of prefabricated sections 170 each having an end plate 172, with a male angle at one end, and an end plate 173 having a corresponding female angle at the other end, so that adjacent ends of the sections can be horizontally aligned by the male and female angles and then bolted together by bolts 174 and nuts 176. Additionally, the mated male and female angles in the adjacent end plates add rigidity to the structure. An external skirt connector 178 is screw connected to the externally disposed skirt 180 made of a "C" channel with a longitudinal integrally formed horizontal slot 182 above the connector. The skirt 180 on the external side runs into the top section 184 upon which the swimmers will walk, with the top section 184 terminating into a coping 186, which serves as the internal side of the walk deck 40.

The top surface 184 of each deck section 170 is formed from a series of channels 236, the flanges of which interlock with and are welded to the flanges of the adjoining channels to form structural boxes 238. The ends of these boxes are in turn welded to the angles 240 which form the end plates 172 and 173 of the deck sections to form a very rigid and sturdy deck section.

The coping 186 also has a longitudinal horizontal slot 188 which serves a dual funtion of (1) receiving and holding the bulbous upper end of the vinyl liner 72; and (2) yieldably snap fitting about the lip 152 of the top "Z" bar 142 to secure the walk deck 40 in assembled position. The skirt as illustrated in FIG. 12 has its lower edge engage the bottom of the cantilevered horizontal brace 166 while the walk deck 40 extends over the brace 166 to place the coping 186 adjacent the "Z" bar 142 to position the slot 188 for snap fit assembly as shown completed in FIG. 4.

The walk deck sections 170 can be as long as desired but it is preferred to make them of such lengths as 6' and 10', or any other convenient modular lengths. A vinyl-T-spline 190 may be inserted into the sections 170, 170 joint to provide a smooth surface between adjacent top sections 184. The top sections 184 will rest upon the tops of the horizontal braces 166 as is shown in FIG. 4.

The pool 20 is enclosed by a picket fence 54 connected about the perimeter of the walk deck 40 and sun deck 38 as shown in FIGS. 2 and 3 and detailed in FIGS. 4 and 13 and 14. A railing or fence post 192 is made of square tubular stock with open top and bottom which is covered by tight-fitting plastic post caps 194, 194. A short distance from the top a horizontal slot 196 is formed on adjacent sides. A flat rail connector 198 is passed through the slots 196, 196 so that each of its ends extend from the sides of post 192. Each outer end of rail connector 198 has an aperture 200 formed therein. An aperture 202 is made through the front and rear face of the post 192 spaced upwardly from the bottom. At predetermined locals along the skirt of the walk deck 40 bolts 204 have their heads non-rotatively inserted into the skirt slot 182. The post 192 is fastened to the skirt 180 by passing the bolt 204 through the apertures 202 and threadedly connecting a nut 206 thereon with protective cap. A lower railing post strap 208 precedes the nut 206 to be connected to the front face of the post 192 with its ends extending beyond the post 192 to act as assembly guide and holder by fitting into the closed end of the "C" channel shaped lower railing 210 which abuts the sides of the post 192.

As seen in FIG. 14, lower lips 232 and 234 respectively of bottom rail 210 mate with upper and lower skirt grooves 228 and 230 respectively of skirt 180, so that the lower railing 210 is both aligned with and supported by skirt 180 due to the coaction of the rail lips with the skirt grooves. By tightening nut 206 against lower railing strap 208, the strap acts like a spring (since its ends are bent gradually inward) to anchor the bottom members 210 adjacent the railing posts 192 into the skirt grooves 228 and 230.

A post support 212 is substantially "U" shaped with the open end having outwardly turned flanges 214 which suitably are connected to the skirt 180 as by welding, self tapping screws or the like to augment the strength of assembly of member 192 to skirt 180. The post support 212 is disposed below the lower railing 210 and has the post 192 pass therethrough so that the post has two points of spaced support connecting it to the skirt 180, namely the bolts 204 and the support 212.

The picket fence 54 is made up of fence sections 216 connected between adjacent fence posts 192, as illustrated in FIGS. 3 and 14. The fence sections 216 have a lower railing 210 and an upper or hand railing 218 with pickets 220 spaced from each other and welded to the railings 210 and 218. A picket track 222 is formed of two parallel projections formed on the surface receiving the pickets 220 with the projections serving to confine the pickets 220 in aligned position for easy weld connection to the respective railing 210 and 218. The pickets 220 pass through apertures in the upper portion of the lower railing 210 to be received within the picket track 222. The upper hand railing 218 is substantially "U" or oval shaped with the opening facing downwardly and the outer sides bent around to extend toward each other, stopping from each other a predetermined distance which defines the width of the pickets 220. After insertion, the pickets 220 can be welded to the in-turned ends of the hand railing 218. The "U" shape of the hand railings 218 leaves a hollow center at its end through which the outer end of the rail connector 198 can pass to be connected to the hand railing 218 by a screw 224. The corners of the picket fence 54 have the railings 210 and 218 cut at 45 degrees to combine and form right angle joints. A top corner connector 226 is used to connect adjacent top railings 218 with screws 224. If desired, a similar connector can be used for the bottom railing 210. At the fence post 192 adjacent the ladder 42 the rail connector 198 will be bent to form a holding tab on the side of the post without the fence section. Likewise, the lower post strap may be cut to fit or its outer end bent to form a holding tab. The lower railing can be secured to the skirt 180 by additional spaced bolts 204 being screw connected to nuts 206 externally of the closed side or external portion of the lower railing 210 which has apertures 228 formed at desired connector points through which the bolts 204 will pass. The use of a continuous skirt slot 182 permits ready adjustment of the bolts 204 to either the posts 192 or lower railing 120 to minimize any alignment problems.

It should be noted that the inserting of the Z-bar flange in the grooves of the wall post interlocks the component sections horizontally at both top and bottom, and makes the pool sides self-aligning, leaving no room for errors in assembling and installing the pool. The interlocking of the component sections at both top and bottom allows the component sections to be preassembled remotely from the site of the pool, and thereby both eases and speeds the assembly and installation of the pool.

Further, the rigid and strong structure of the walk deck sections (using channels welded to form stiffening boxes which are welded in turn to end angle members) and the interlock of the walk deck sections by means of coacting male and female members enables rapid assembly of the walk deck sections. At the same time the design produces an assembled structure which is an integral part of the pool acting as a truss to retain the water pressure at the top portion of the pool. This is in contrast with the prior art pools where the deck is usually a burdonsome appendage hanging from the side of the pool or supported from the ground.

Additionally, the design of the fence makes it an integral part of the entire deck system, with each picket securely fastened to the deck giving it utmost strength as compared to the weak railing normally encountered in pool decks.

It should also be noted that the A-frame assembly described above is easily erected with a minimum number of fasteners. Only one screw and nut locks the entire A-frame, eliminating welding. Further, the A-frame is self-interlocking, so that the greater the water pressure exerted against the A-frame, the greater are the forces which hold the components of the frame together. Therefore, water pressure in the pool will work to increase the soundness of the structure, rather than work against it. Therefore, once the incline member of the A-frame is locked into the slots of the vertical members, as described, and it is locked in the bottom horizontal member, it cannot separate, nor can the vertical and horizontal members separate from each other.

The entire concept of the above-discussed swimming pool provides for interlocking members which when placed under stress of water filling the pool tend to become more firmly interlocked to form a self-contained truss system which does not require the numerous fastening means which have normally been provided in prior art swimming pools. The simplicity and economy of design of the present invention as well as its novel design concept provide an extremely effective, easily assembled, and relatively durable structure.

It will be understood that various changes in the details, materials, arrangements of parts and operating conditions which have been herein described and illustrated in order to explain the nature of the invention may be made by those skilled in the art within the principles and scope of the invention.

Having thus set forth the nature of the invention, what is claimed is:

1. A swimming pool retaining wall comprising:
(a) a plurality of spaced wall posts mounted on concrete footings;
(b) a pair of interconnected frame members supported on the footing connected to and supporting the wall post on the external face thereof;
(c) a deck support extending in superposition to the frame members connected at the top of the wall post;
(d) horizontal braces notch connected between adjacent wall posts;
(e) a pair of reversible "Z" bars connected on the top and bottom of the internal face of the wall posts;
(f) each of the "Z" bars having a flange on one side and a groove on the other side each extending in the opposite direction;
(g) the wall post having horizontal slots into which the flange of each of the "Z" bars is inserted to position the grooves on the top and bottom facing each other;
(h) fastening means affixing the "Z" bars to the wall posts;
(i) wall sections slid between and held by the grooves of the "Z" bars;
(j) a walk deck non-fastenerly connected to the deck support by one edge fixedly engaging the underside of the deck support and the other edge yieldably engaged at the groove of the top "Z" bar; and
(k) a plastic pool liner affixed to the yieldable edge of the walk deck.

2. The combination claimed in claim 1 wherein:
(a) a fence post connected to the fixed edge of the walk deck;
(b) a top railing connected to the fence post;
(c) a bottom railing connected to the fence post and the fixed edge of the walk deck; and
(d) a plurality of spaced pickets affixed between the top and bottom railings.

3. The combination claimed in claim 2 wherein:
(a) a longitudinal slot extending substantially the full length of the fixed edge of the walk deck on the external face thereof; and
(b) a plurality of non-rotatable bolts slidably received in the slot to be positioned for connecting the fence posts and bottom railing to the fixed edge of the walk deck.

4. The combination claimed in claim 3 wherein:
(a) the fence post is slotted on its adjacent sides near the top;
(b) a rail connector is disposed in the slots to have its ends cantilever outwardly of the post on each side thereof;
(c) the upper railing is formed substantially "U" shaped whereby the rail connector extension will fit into the interior hollow of the upper railing; and
(d) screw fastener means connecting the upper railing to the rail connector so that adjacent upper railings sandwich the fence post therebetween in locked position.

5. The combination in claim 3 wherein:
(a) upper and lower skirt grooves disposed above and below the longitudinal slot; and
(b) upper and lower lips on said bottom railing adapted to mate with said upper and lower skirt grooves to align and support said bottom railing.

6. A retaining wall for a swimming pool having "A" frame supports, comprising:
(a) a pair of members each having a flat oblong face with longer parallel sides each connected to a plane perpendicular with said side;
(b) said pair of members having ends connected at substantially right angles to each other;
(c) said flat oblong face of one of said pair of members being vertically disposed, the other of said flat oblong face of said pair of members being horizontally disposed;
(d) each of the members having a plurality of parallel non coaxially disposed slots on each of said flat oblong faces on the side facing each other;
(e) an inclined member having notched sides at each end inserted into the slots of each of the pair of members;
(f) said notched sides of said inclined member shaped to coact with the slots of each of the pair of members to resist forces tending to displace said vertical and horizontal members towards each other; and
(g) a clamp means connected betwen the inclined member and one of the pair of members to lock the interconnected members in assembled position.

7. A retaining wall for a swimming pool having "A" frame supports, comprising:
a pair of members connected at substantially right angles to each other;
(b) each of the members slotted on the side facing each other;
(c) an inclined member having notched sides at each end to be inserted into and interconnecting with the slots of each of the pair of members;
(d) a clamp means connected between the inclined member and one of the pair of members to lock the interconnected members in assembled position;

(e) the clamp means include a tie bolt;
(f) the tie bolt has "T" shape with a head formed at the cross piece and the stem having a threaded end;
(g) the head having a central aperture therethrough;
(h) an aperture formed the one member carrying the clamp means;
(i) pin means pivotally disposed into the apertures of the one member and the head to connect the one member and the tie bolt;
(j) the inclined member having an aperture which received the threaded end of the stem; and
(k) nut means threadedly received on the stem to clamp the inclined member to the one member via the tie bolt.

8. The combination claimed in claim 7 wherein:
(a) the pair of members comprise a horizontal member and a vertical member; and
(b) the tie bolt is pivotally affixed, via the pin, to the horizontal member.

9. The combination claimed in claim 8 wherein:
(a) the inclined member defines a "C" channel with an open bottom;
(b) the horizontal memeber defines a channel member with a open top;
(c) the inclined member fits within the horizontal member; and
(d) the head of the tie bolt is disposed within the open top of the horizontal member to be affixed thereto.

10. The combination claimed in claim 9 wherein:
(a) the horizontal member has two opposite sides adjacent the open top thereof;
(b) each side has an aligned aperture therein;
(c) the head aperture aligned with the side apertures; and
(d) the pin extending into the side apertures and through the head aperture.

11. A support for a swimming pool retaining wall comprising:
(a) a vertical member having a flat oblong face with longer parallel sides each connected to a plane perpendicular with said side;
(b) said vertical member having a plurality of parallel non coaxially disposed slots on said vertical flat oblong face spaced from the bottom;
(c) a horizontal member having a flat oblong face with longer parallel sides each connected to a plane perpendicular with said side;
(d) said horizontal member connected at the bottom of said vertical member;
(e) said horizontal member having a plurality of parallel non coaxially disposed slots on said horizontal flat oblong face formed adjacent its free end;
(f) an inclined member having its opposite ends notched to be interlocking received by said plurality of non coaxially disposed slots of each of the vertical and horizontal members;
(g) said notched ends of said inclined member shaped to coact with said plurality of slots of each of said vertical and horizontal members to resist forces tending to displace said vertical and horizontal members toward each other whereby a rigid support triangle is formed by the interconnected members upon subjecting said vertical member to a horizontal force parallel to and towards the end remote from the end connected with the horizontal member.

12. The combination claimed in claim 11 wherein:
(a) one end of the inclined member having a flat projection;
(b) the flat projection having a step formed on one edge terminating in a shoulder;
(c) the other edge having an inclined slot aligned with the shoulder and formed near its end; and
(d) a slot formed in one of the adjacent members to receive the flat projection of the inclined member wherein the slot and shoulder of the inclined member will be seated upon the adjacent member with the flat projection locked within the slot of the adjacent member.

13. The combination claimed in claim 12 wherein:
(a) and flat projection is formed on the bottom end of the inclined member;
(b) the inclined member is disposed a substantially 45 degrees;
(c) the horizontal member is slotted adjacent its outer end;
(d) the top edge of the inclined member is slotted at a substantially 45-degree angel inclined toward the top end; and
(e) the slot of the inclined member will engage the slot of the horizontal member at its outer end.

14. A support assembly for a swimming pool retaining wall comprising:
(a) a vertical member having a slot therein spaced from the bottom;
(b) a horizontal member connected at the bottom of the vertical member;
(c) the horizontal member having a slot formed adjacent its free end;
(d) an inclined member having its opposite ends notched to be interlocking received in te slots of each of the vertical members whereby a rigid support triangle is formed by the interconnected member;
(e) one end of the inclined member having at least one flat projection;
(f) the flat projection having a pair of spaced "V" notches formed thereof on opposite sides thereof;
(g) the width of the flat projection slightly less than that of the slot to permit its insertion into the slot; and
(h) the inclined member disposed perpendicular to the adjacent member for insertion of its flat projection into the slot of said member whereby once inserted therein the inclined member will be swung toward the other member to engage the notches within the slot and lock the same therein.

15. The combination claimed in claim 14 wherein:
(a) the flat projection formed on the upper end of the inclined member;
(b) the vertical member having a vertical slot formed therein; and
(c) the flat projection inserted into the vertical slot.

16. The combination claimed in claim 15 wherein:
(a) the flat projection having a top edge and a bottom edge;
(b) each of the edges having a substantially "V" shaped notch therein; and
(c) the inclined member disposed horizontally for insertion of the flat projection into the slot of the vertical member.

17. The combination claimed in claim 16 wherein:
(a) the notch on the top edge closer to the upper end of the inclined member than the notch on the bottom edge.

18. The combination claimed in claim 17 wherein:

(a) each of the "V" notches of a substantially combined size of less than 25% of the width of the flat projection.

19. A method of forming a quick fastening support assembly for a swimming pool retaining wall comprising the steps of:

(a) connecting a slotted vertical member and a slotted horizontal member together at substantially a right angle;

(b) inserting the upper notched end of an inclined member horizontally into the slots of the vertical member;

(c) swinging the inclined member downwardly to align its lower notched end with the slots of the horizontal member;

(c) inserting the notched lower and into the slots of the horizontal member; and (e) sliding the notched lower end into locked position within the slots of the horizontal member whereby the upper notched end of the inclined member is non-removably interlocked within the slots of the vertical member.

20. The method claimed in claim 19 including the steps of:

(a) clamping the inclined member to one of the other members to lock the inclined members between the other two members.

* * * * *